US006547900B2

(12) United States Patent
Canterberry et al.

(10) Patent No.: US 6,547,900 B2
(45) Date of Patent: Apr. 15, 2003

(54) METHOD OF STABILIZING THE DENSITY OF GAS GENERANT PELLETS CONTAINING NITROGUANIDINE

(75) Inventors: J. B. Canterberry, Apollo Beach, FL (US); Mark A. Schmidt, Winter Haven, FL (US); Edward O. Hosey, Lakeland, FL (US); Robert K. Walsh, Lakeland, FL (US); John H. Adams, Lakeland, FL (US)

(73) Assignee: Breed Automotive Technology, Inc., Lakeland, FL (US)

( * ) Notice: Subject to any disclaimer, the term of this patent is extended or adjusted under 35 U.S.C. 154(b) by 45 days.

(21) Appl. No.: 09/768,684

(22) Filed: Jan. 24, 2001

(65) Prior Publication Data

US 2002/0096236 A1 Jul. 25, 2002

(51) Int. Cl.[7] ..... C06B 21/00

(52) U.S. Cl. ..... 149/109.6; 149/47; 149/48; 264/3.4

(58) Field of Search ..... 149/47, 48, 109.6; 264/3.4

(56) References Cited

U.S. PATENT DOCUMENTS

| | | | | |
|---|---|---|---|---|
| 3,927,836 A | * | 12/1975 | Thurgood et al. | 241/19 |
| 4,544,769 A | * | 10/1985 | Engel et al. | 564/242 |
| 4,967,000 A | * | 10/1990 | Sanchez et al. | 564/242 |
| 5,531,941 A | | 7/1996 | Poole | 264/3.4 |
| 5,545,272 A | | 8/1996 | Poole et al. | 149/48 |
| 5,641,938 A | | 6/1997 | Holland et al. | 149/48 |
| 5,735,118 A | | 4/1998 | Hinshaw et al. | 60/219 |
| 5,747,730 A | | 5/1998 | Scheffee et al. | 149/47 |
| 5,756,929 A | * | 5/1998 | Lundstrom et al. | 149/36 |
| 5,989,367 A | * | 11/1999 | Zeuner et al. | 149/36 |
| 6,017,404 A | | 1/2000 | Lundstrom et al. | 149/36 |
| 6,306,232 B1 | * | 10/2001 | Khandhadia et al. | 149/22 |

FOREIGN PATENT DOCUMENTS

| | | |
|---|---|---|
| EP | 0992473 | 4/2000 |
| GB | 681095 | 10/1952 |
| WO | 9627574 | 9/1996 |
| WO | 9729927 | 8/1997 |

* cited by examiner

*Primary Examiner*—Edward A. Miller
(74) *Attorney, Agent, or Firm*—Jarett Rieger

(57) ABSTRACT

A non azide gas generant composition of nitroguanidine and phase stabilized ammonium nitrate is provided. This gas generant composition has many desirable characteristics such as little production of ash and the production of essentially toxic free exhaust gas. When nitroguanidine is compressed into a pellet it has needle shaped crystals that bend or distort. When the gas generant pellets are subjected to thermal cycling some nitroguanidine crystals will return to their native conformation resulting in pellet growth. To eliminate this pellet growth, nitroguanidine is passed through a VBM mill. The media in the VBM mill pulverizes the nitroguanidine into an amorphous crumb.

12 Claims, 3 Drawing Sheets

METHOD OF STABILIZING THE DENSITY OF GAS GENERANT PELLETS CONTAINING NITROGUANIDINE

FIELD OF THE INVENTION

The present invention relates to non toxic gas generants which upon combustion, rapidly produce gas that is useful for inflating a vehicle airbag, and specifically the present invent relates to the process of grinding nitroguanidine, the fuel in the gas generant.

BACKGROUND OF THE INVENTION

Vehicle airbag systems have been developed to protect a vehicle occupant in the event of a crash by rapidly inflating a cushion between the vehicle occupant and the interior of the vehicle. The gas for inflating the vehicle airbag is produced by a chemical reaction in an inflator. In order for an airbag to function properly, the airbag needs to be deployed within a fraction of a second.

For a pyrotechnic inflator, the gas production is a result of the combustion of a fuel inside the inflator. Both organic and inorganic fuels can be utilized for gas generants. Sodium azide, an example of an inorganic fuel, was the most widely used and accepted fuel for gas generants. The combustion of sodium azide occurs at a very rapid rate, which made it a suitable material for use as a gas generant. However, sodium azide has several inherent problems which has lead to extensive research on developing gas generants based on non-azide fuels. Sodium azide is a toxic starting material, since its toxicity level as measured by oral rat LD50 is in the range of 45 mg/kg. Another disadvantage of using sodium azide is that some of the combustion products can be toxic and corrosive. Recently, a new problem has surfaced concerning the disposal of unused airbag systems in cars at the end of their service life.

Because of the foregoing problems associated with sodium azide, the industry has developed many non-azide gas generants that are being used in some airbag inflators. One of the disadvantages of known non-azide gas generant compositions is the amount and physical nature of the solid residues formed during combustion. These solid combustion products must be filtered and kept away from contact with the vehicle occupants. It is therefore highly desirable to develop non-azide chemical compositions that have a higher gas conversion rate and produce essentially no slag or solid particles. Another disadvantage of using non-azide generants is that toxic side products of CO and NOx can be produced. The stoichiometric ratio and chemical structure of the reactants has a huge bearing on the levels of CO and $NO_x$ that are produced.

Many non-azide fuels have been researched that when mixed with the proper oxidizer produces little ash or slag during combustion and produce tolerable levels of toxic gas. Nitroguanidine is a fuel that when properly formulated possesses these desirable properties. Nitroguanidine is rich in nitrogen and burns very cleanly. The disadvantage of utilizing nitroguanidine is that when the fuel is compressed into a pellet, the pellet will grow or lose density when subjected to thermal cycling causing the ballistic properties to be altered.

DISCUSSION OF THE PRIOR ART

U.S. Pat. No. 5,531,941 teaches a gas generant composition that has a very high gas yield and low yield of solid combustion products. One of the preferred gas generant composition consists of (a) about 59.4 wt. % of phase stabilized ammonium nitrate (b) about 32.48 wt. % of triaminoguanidine nitrate and (c) about 8.12 w % of guanidine nitrate.

U.S. Pat. No. 5,545,272 teaches a gas generating composition consisting of a mixture of nitroguanidine and phase stabilized ammonium nitrate. The patent does not address the influence of nitroguanidine on pellet size during thermal cycling.

U.S. Pat. No. 5,641,938 teaches a gas generating composition consisting of nitroguanidine, phase stabilized ammonium nitrate, and an elastomeric binder. The binder functions to control pellet growth.

U.S. Pat. No. 5,747,730 teaches a eutectic solution for a gas generant comprising ammonium nitrate, guanidine nitrate and/or aminoguanidine nitrate, and minor amounts of polyvinyl alcohol and either potassium nitrate or potassium perchlorate. The eutectic solution with the foregoing components will eliminate pellet cracking and substantially reduce ammonium nitrate phase change due to temperature cycling.

SUMMARY OF THE INVENTION

One aspect of the present invention is to grind nitroguanidine needles that will be used in a gas generant composition. When synthesized, nitroguanidine precipitates from solution as tough needles. Grinding or crumbling the nitroguanidine needles prevents the fuel from losing density during thermal cycling. The grinding converts the needle crystals to an amorphous crumb.

An advantage of the present invention is that the burn rate is increased because of increased particle size surface area. The burn rate for the preferred gas generant formulation is about 0.6 inches per second at 1000 psi.

Another advantage of the present invention is that it is not necessary to add a binder to stabilize the density of the gas generant containing nitroguanidine.

DETAILED DESCRIPTION OF THE INVENTION

Figure 1:
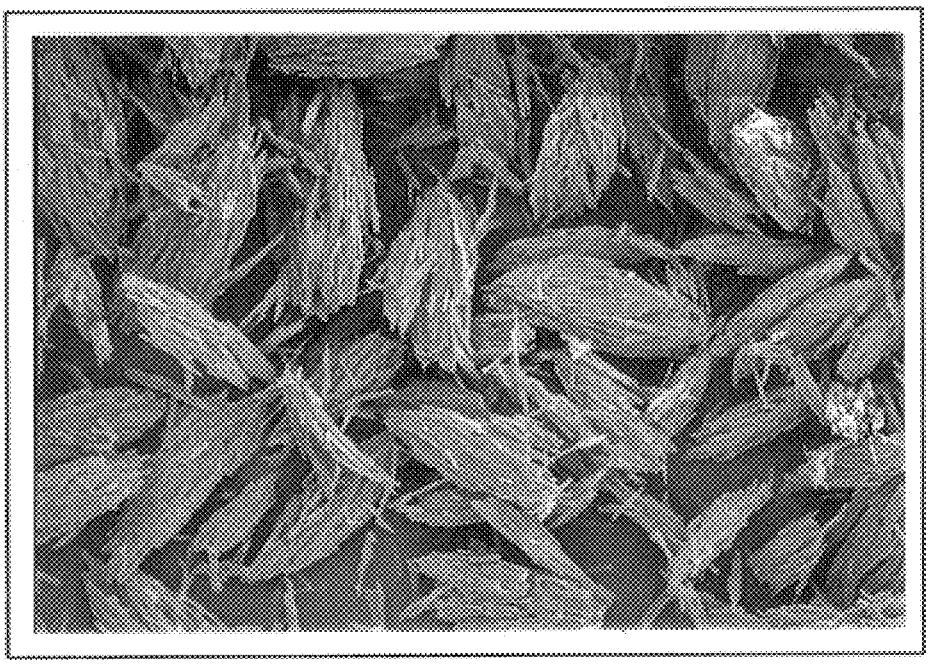
FIG. 1 is a pictorial representation of nitroguanidine as it appears under 180 X magnification, when the nitroguanidine has not undergone any grinding.

The gas generant composition manufactured according to of the invention is suitable for use with a variety of pyrotechnic devices, in particular, airbag inflators. In inflators, the combustion of the fuel in the gas generant produces gas, which is used to inflate a vehicle airbag. In formulating a fuel for the gas generant, it is desirable to maximize the nitrogen content of the fuel and limit the amount of carbon and hydrogen. There are a number of non-azide fuels rich in nitrogen, which include tetrazoles, bitetetrazoles, 1,2,4-triazole-5-one, guanidium nitrate, nitroguanidine, aminoguanidine, and the like. The preferred fuel for this invention is nitroguanidine because it contains one molecule of oxygen in its structure thereby being able to partially self oxidize.

The drawback of using unground nitroguanidine in a gas generant is the gas generant pellets undergo changes in density when subjected to thermal cycling. If a gas generant changes density, then the ballistic properties of the gas generant will be altered and the gas generant will burn in an unpredictable fashion.

Nitroguanidine exists in at least two crystal modifications, an alpha and a beta. The alpha form is a long white lustrous needle, which is very tough. This is the form most commonly used in propellants and explosives. The beta form has crystals that form in a cluster of small, thin elongated plates. The beta form may be converted to the alpha form by dissolution in concentrated sulfuric acid and quenching with water.

When unground nitroguanidine is pressed into a pellet or tablet its needles bend or become distorted. During thermal cycling, the energy supplied to the gas generant causes the nitroguanidine needles to revert back to their original geometry or native conformation. This results in the pellets growing because the unbending of the nitroguanidine needles and returning to the native shape will leave gaps or holes in the pellet. One solution to the foregoing problem is to add a binder to the gas generant. The binder prevents the gas generant pellet from growing during thermal cycling by securing the nitroguanidine needles in their reduced geometry. There is a twofold disadvantage for adding the binder. First, there is an added expense in preparing the gas generant because there is an additional step in production. Second, the gas generant formulation has a binder component, which will increase the total carbon in its formulation requiring more oxidizer. Binders are typically organic and as a result contain a high percentage of carbon, which is not desirable because carbon monoxide can be produced, and the average molecular weight of the combustion gas produced is higher. This results in fewer moles of gas produced.

The preferred means of stabilizing the size or density of gas generant is by grinding nitroguanidine to amorphous crumbs. The preferred process of grinding nitroguanidine will be discussed later.

A preferred oxidizer for the gas generating composition is ammonium nitrate because it contains no solid forming material upon combustion. One of the major problems with using ammonium nitrate is that it undergoes several crystalline phase changes, one of which occurs at approximately 32° C. and is accompanied by a three percent change in volume. When a gas generant containing a significant amount of ammonium nitrate is thermally cycled, the ammonium nitrate crystals can expand or contract, which will effect the ballistic properties of the gas generant. For example excessive gas pressure can be generated which could possibly result in the rupturing of the housing. Several methods of stabilizing ammonium nitrate are known and the preferred method is by co-melting ammonium nitrate with potassium nitrate. Co-melting produces a solid solution of ammonium nitrate and potassium nitrate whereby the crystal phase change of ammonium nitrate is interfered with and cannot occur. On one hand, the addition of potassium nitrate is extremely advantageous because it eliminates the phase changes of ammonium nitrate, but on the other hand, this chemical introduces a metal ion to the gas generant, which can produce slag or airborne particles upon combustion. Thus, the amount of potassium nitrate added should be limited so only enough potassium nitrate to stabilize ammonium nitrate is used, generally 5–15%.

The synergistic effect of nitroguanidine in combination with phase stabilized ammonium nitrate results in a very clean burning gas generant, which produces minimal slag or ash. Since a reduced amount of slag is produced, the amount of filter can be reduced. As a result of these benefits, the components, weight, and manufacturing costs for inflators are reduced.

The preferred formulation for the non-azide generant employing the invention is 32–50% by weight of nitroguanidine, 50–68% by weight phase stabilized ammonium nitrate, less than 2% by weight of silica, and less than 2% by weight of boron nitride. Phase stabilized ammonium nitrate comprises a solid solution of ammonium nitrate and potassium nitrate and the preferred formulation is 85–95% by weight of ammonium nitrate and 5–15% by weight of potassium nitrate. The silica and boron nitride are added as processing aids.

According to the present invention, the gas generant formulation eliminates the crystalline phase changes of ammonium nitrate by incorporating potassium nitrate within ammonium nitrate through a co-melt process forming a solid solution. Also, a gas generant employing the present invention, may be free of any binders because the crystal structure of nitroguanidine, through grinding, has been modified and changed from a tough needle to an amorphous crumb. Moreover, the present invention increases the burn rate of the fuel from around 0.2 inches per second at 1000 psi to 0.6 inches per second at 1000 psi.

The ignition of the gas generant or propellant employing the present invention produces products that are essentially non-toxic and particulate free. The conversion rate of the solid gas generant to gas is approximately 96%.

The following description is a general process for forming gas generant pellets. First, phase stabilized ammonium nitrate (hereinafter will be referred to as "PSAN") is a solid solution of potassium nitrate and ammonium nitrate. The PSAN is ground to a powder in the range of 10–25 microns.

Before the nitroguanidine is mixed with PSAN, it needs to be ground to a crumb. Various methods of crumbling the nitroguanidine are discussed later. Nitroguanidine, PSAN, and a carrier solvent such a water or acetone are introduced into a planetary mixer to agglomerate the eclectic mixture into granules having a melting point greater than 125° C. The eclectic mixture is passed through a mesh, granulated into discrete chunks, and then brought to an anhydrous state by drying.

Small amounts of boron nitride and silica were mixed with the dried mixture. The silica is used as a flow agent and the boron nitride is used to reduce sticking to the press punches. Lastly, the eclectic mixture was converted into individual pellets by compression molding with a pellet press.

EXAMPLE 1

FIG. 1 is a pictorial representation of unground alpha nitroguanidine (hereinafter referred to as "nitroguanidine"). Nitroguanidine crystals have a needle shape geometry, and the needles are clustered together in bundles.

A gas generant pellet was prepared using unground nitroguanidine with the composition of 52% by weight of ammonium nitrate, 3% by weight of ammonium nitrate, 44% by weight of unground nitroguanidine, 1% by weight of boron nitride, and 0.025% by weight of silica. The gas generant pellet was compressed into a tablet or pellet during which the nitroguanidine was bent and distorted out of its native conformation. The phase stabilized ammonium nitrate composition was not changed for any of the tests performed on the gas generant. The density of the pellet was 1.67 g/cc. After 200 thermal cycles, the density reduced to 1.60 g/cc. According to this experiment, one thermal cycle equals −35° C. for two hours to 85° C. for two hours with a fifteen-minute ramp between the two temperatures. This data illustrates that the density was reduced during thermal cycling which can be attributed to the needles of nitroguanidine returning to their native conformation of tough straight needles.

Ballistic tests were also performed on a gas generant pellet with the composition 52% by weight of ammonium nitrate, 3% by weight of potassium nitrate, 44% by weight of unground nitroguanidine, 1% by weight of boron nitride, and 0.025% by weight of silica. The uncycled combustion pressure at ambient temperature of this formulation was determined to be 5973 psi. After this formulation was subjected to 200 thermal cycles the pressure increased to 12,170 psi at ambient temperature. The combustion pressure of gas generant pellets with unground nitroguanidine is significantly increased from thermal cycling, and consequentially gas generants with unground nitroguanidine have unpredictable ballistic properties rendering them unsafe for use in vehicles.

EXAMPLE 2

Figure 2:
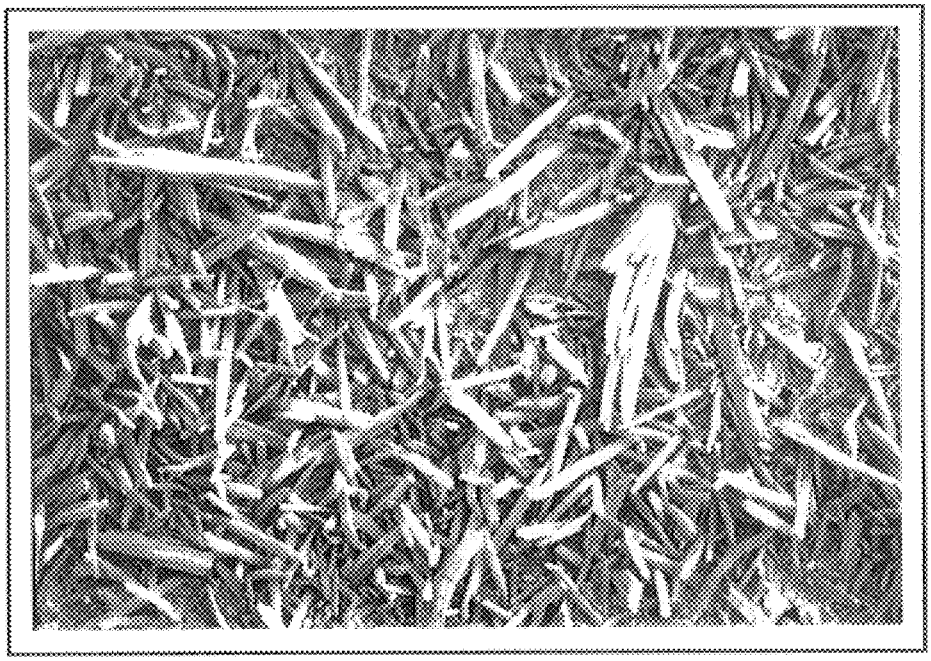
FIG. 2 is a pictorial representation of nitroguanidine as it appears under 400 X magnification when the nitroguanidine was crumbled by a jar mill.

FIG. 2 is a pictorial representation of nitroguanidine that has been ground by a jar mill. The jar mill was successful in breaking up the bundles of needles, but as shown in the picture, the needles are still present. Since the jar mill did not fragment the needles, the needles will still bend or distort during compression of the eclectic mixture into pellets and thus cause the pellets to grow during thermal cycling.

EXAMPLE 3

Figure 3:
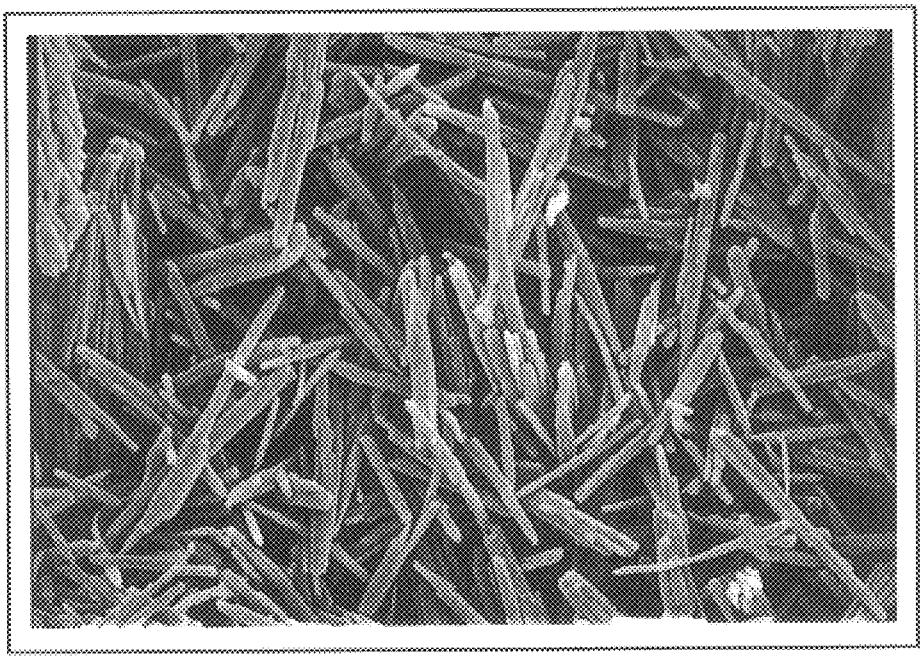
FIG. 3 is a pictorial representation of nitroguanidine as it appears under 650 X magnification when the nitroguanidine was crumbled by a hammer mill.

FIG. 3 is a pictorial representation of nitroguanidine that has been ground by a hammer mill. As seen in the Figure, the needle clusters are disrupted but clearly defined needles are still present. The presence of the needles will lead to pellet growth during thermal cycling.

EXAMPLE 4

Figure 4:
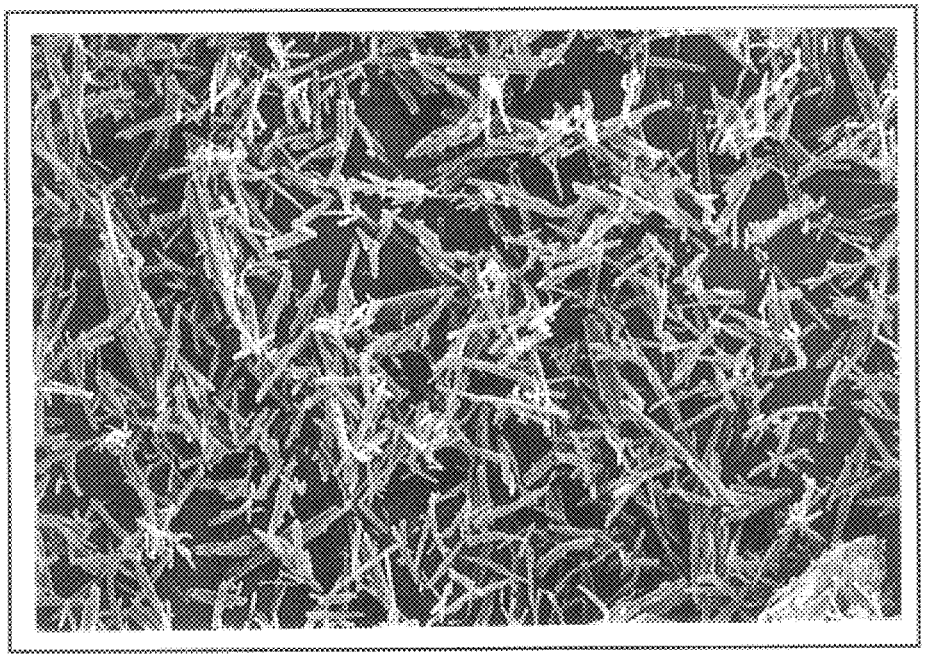
FIG. 4 is a pictorial representation of nitroguanidine as it appears under 300 X magnification when the nitroguanidine was crumbled by a Sweco mill.

FIG. 4 is a pictorial representation of nitroguanidine that has been ground by a Sweco mill. Similar to the hammer mill, the crystals are still present and thus the pellet will grow during thermal cycling.

EXAMPLE 5

Figure 5:
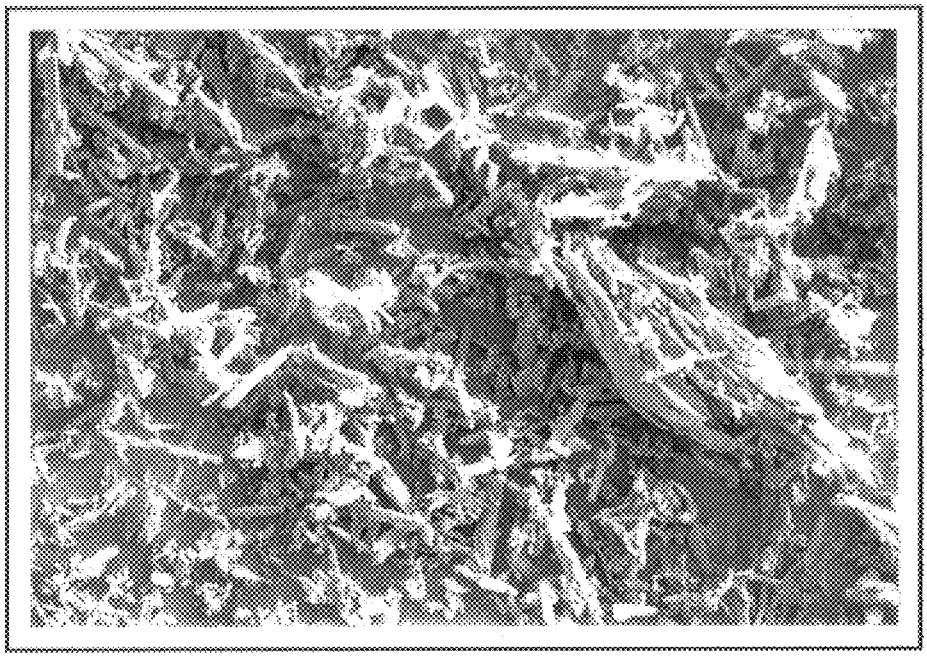
FIG. 5 is a pictorial representation of nitroguanidine as it appears under 400 X magnification when the nitroguanidine has been passed through a vibrating ball mill once.
Figure 6:
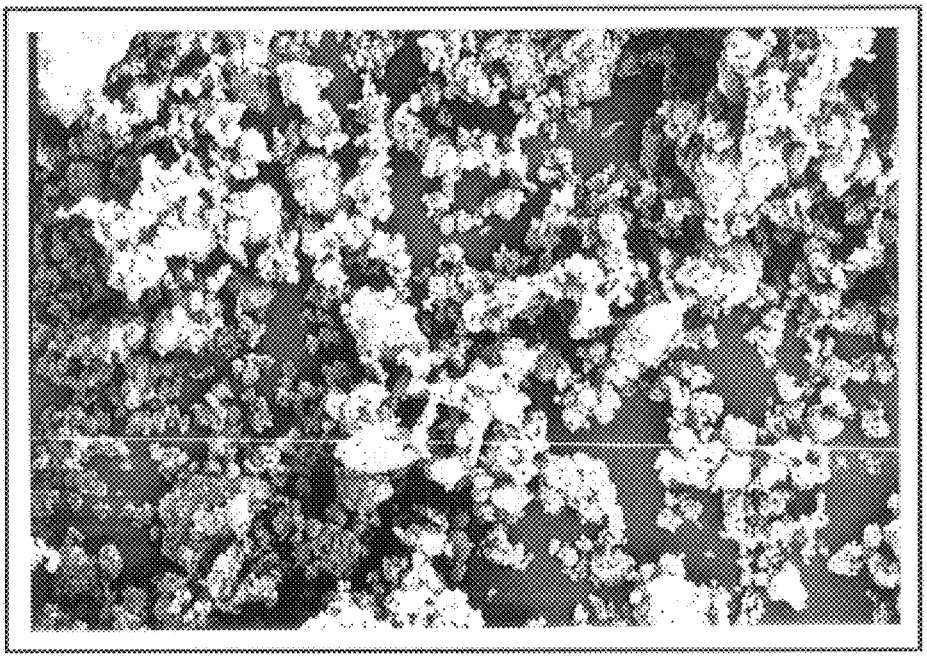
FIG. 6 is a pictorial representation of nitroguanidine as it appears under 400 X magnification when the nitroguanidine has been passed through a vibrating ball mill twice.

FIG. 5 depicts nitroguanidine that was pressed through a Palla mill or vibrating ball mill (hereinafter referred to as "VBM"). The nitroguanidine was reduced from a crystalline needle structure to an amorphous crumb having insufficient structure to move during thermal cycling. Before nitroguanidine was added to the VBM mill, the VBM mill was preloaded with about two hundred pounds of media. The media selected was made from alumina and had a circular cylindrical shape with a length of 1.27 cm. As the nitroguanidine passes through the machine, the machine vibrates along three axes at an ultra-high frequency, which causes the media to pulverize the nitroguanidine. The preferred media for use with the VBM mill is alumina, but one skilled in the art would recognize that other media could be used for this function. The VBM mill used is a standard VBM mill with two barrels. FIG. 5 shows nitroguanidine after one pass through the VBM mill, and FIG. 6 shows nitroguanidine after two passes through the VBM mill.

Tests were performed on a gas generant comprising 52% by weight of ammonium nitrate, 3% by weight of potassium nitrate, 44% by weight of VBM mill ground nitroguanidine, 1% by weight of boron nitride, and 0.025% by weight of silica. The phase stabilized ammonium nitrate composition was not changed for any of the tests performed on the gas generant. The density of the gas generant pellet was 1.67 g/cc and the density changed only marginally to 1.65 g/cc after 200 thermal cycles. Combustion-chamber pressure for the cycled and uncycled generant show no significant difference with 6000 psi for the uncycled and 6300 psi for the generant undergoing 200 cycles.

While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall with the spirit and broad scope of the appended claims.

We claim:

1. A process for preparing an azide-free gas generant composition that produces exhaust gases on combustion for inflating a vehicle restraint device, said composition comprising phase stabilized ammonium nitrate and nitroguanidine, said process comprising the steps of:

a. grinding nitroguanidine into an amorphous crumb by using a vibrating ball mill, and b. mixing the nitroguanidine with the phase stabilized ammonium nitrate.

2. The process of claim 1, wherein the gas generant comprises about 32–50% by weight of nitroguanidine and 50–68% by weight of phase stabilized ammonium nitrate.

3. The process of claim 1, wherein the phase stabilized ammonium nitrate comprises ammonium nitrate and potassium nitrate.

4. The process of claim 1, wherein the gas generant composition further comprises less than 2% by weight of silica and less than 2% by weight of boron nitride.

5. The process of claim 1, wherein the vibrating ball mill is Preloaded with alumina media that pulverizes the nitroguanidine to a crumb.

6. The process of claim 1, wherein the nitroguanidine is passed through the vibrating ball mill twice.

7. A process for preparing an azide-free gas generant composition that produces exhaust gases on combustion for inflating vehicle restraint device, said process comprising the steps of:

a. grinding nitroguanidine into an amorphous crumb by using a vibrating ball mill, and b. mixing the nitroguanidine with phase stabilized ammonium nitrate.

8. The process of claim 7, wherein the vibrating ball mill is preloaded with alumina media that pulverizes the nitroguanidine.

9. The process of claim 8, wherein the nitroguanidine is passed through the vibrating ball mill twice.

10. A process for preparing an azide-free gas generant composition that produces exhaust gases on combustion for inflating vehicle restraint device, said process comprising the steps of:

a. grinding nitroguanidine to an amorphous crumb by using a vibrating ball mill, b. mixing the nitroguanidine with phase stabilized ammonium nitrate and a carrier solvent to form a eutectic mixture, c. drying the eutectic mixture to remove solvent, d. combining the eutectic mixture with boron nitride and silica, and e. creating gas generant pellets from the eutectic mixture by compression molding.

11. The process of claim 10, wherein the nitroguanidine is pulverized by an alumina media by being passed through a vibrating ball mill.

12. The process of claim 11, wherein the nitroguanidine is passed through the vibrating ball mill twice.

* * * * *